US005581162A

United States Patent [19]

Takita

[11] Patent Number: 5,581,162

[45] Date of Patent: Dec. 3, 1996

[54] CRT DISPLAY

[75] Inventor: Hidenori Takita, Nagasaki, Japan

[73] Assignee: Mitsubishi Denki Kabushiki Kaisha, Tokyo, Japan

[21] Appl. No.: 894,932

[22] Filed: Jun. 8, 1992

[30] Foreign Application Priority Data

Oct. 17, 1991 [JP] Japan ..... 3-296613

[51] Int. Cl.[6] ..... H01J 29/51

[52] U.S. Cl. ..... 315/368.25

[58] Field of Search ..... 315/368.25, 368.26, 315/370, 368.27

[56] References Cited

U.S. PATENT DOCUMENTS

| | | | |
|---|---|---|---|
| 3,398,320 | 8/1968 | Hursh . | |
| 3,631,296 | 12/1971 | Collie, Jr. . | |
| 3,930,185 | 12/1975 | Barkow et al. | 315/370 |
| 5,086,259 | 2/1992 | Sakurai et al. | 315/368.25 |

FOREIGN PATENT DOCUMENTS

| | | |
|---|---|---|
| 2007713 | 7/1971 | Germany . |
| 1285514 | 11/1971 | Germany . |
| 4026674 | 2/1991 | Germany . |
| 4029574 | 3/1991 | Germany . |
| 63-105250 | 7/1988 | Japan . |

*Primary Examiner*—Theodore M. Blum
*Attorney, Agent, or Firm*—Burns, Doane, Swecker & Mathis, LLP

[57] ABSTRACT

A CRT display for producing picture images on a cathode ray tube comprising a bipolar electromagnet located at a neck portion of a cathode ray tube and having field coils to produce a bipolar magnetic field for imparting a corrective horizontal or vertical deflection to an electron beam being deflected by the deflection yoke, upon receiving, from a current supply circuit, a sawtooth current with positive and negative alternations in synchronism with the deflection current of the cathode ray tube. The bipolar electromagnet is adopted to produce a bipolar magnetic field on the basis of an alternating sawtooth current which is supplied to its field coils in synchronism with the deflection current.

9 Claims, 10 Drawing Sheets

CRT DISPLAY

BACKGROUND OF THE INVENTION

1. Field of the Invention

This invention relates to a CRT display which produces picture images on a cathode ray tube, and more particularly to a CRT display which exhibits an improved color purity.

2. Description of the Prior Art

Shown by way of example in FIG. 1 is a fragmentary sectional view of a shadow mask type color CRT display (hereinafter referred to simply as "CRT" for brevity) which appeared in "TV TECHNOLOGY", pp. 43–50, June 1990. In this figure, indicated at 1 is a CRT, at 2 is a panel of a plate-like shape, and at 3 is a funnel of a funnel-like shape. The panel 2 and funnel 3 are integrally formed of glass to constitute an envelope of CRT 1.

Indicated at 4 is an electron gun which is located within the envelope at a neck portion of the funnel 3, and at 5 is a shadow mask located within the envelope along the panel 2. Denoted at 6 is fluorescent material of three primary colors coated on the inner surface of the panel 2 to emit blue, green or red light.

The reference 7 indicates an electron beam which is produced by the electron gun 4 to excite a corresponding one of the fluorescent materials of the three colors. Designated at 8 is a deflection yoke for scanning each electron beam on and along the fluorescent material 6 of the corresponding color.

In operation, the shadow mask which is generally referred to as a color-selecting electrode containing a multitude of perforations functions in such a way as to let each of the electron beams for the respective colors reach only the fluorescent material of the corresponding color while blocking the electron beam for the fluorescent material of the other colors.

With regard to the material of the shadow mask itself, it has been the general practice to employ a metal in consideration of the etching process usually resorted to for forming the perforations, the workability into a desired shape, the function as an anode, etc.

As mentioned above, the shadow mask 5 plays the role of blocking electron beams 7, so that its temperature is elevated by the impinging energy of the electron beams 7. The temperature elevation gives rise to a problem of thermal expansion because metal is used for the shadow mask as mentioned before. More specifically, the shadow mask which is generally formed in a spherical shape undergoes thermal deformation as indicated at *5a* and *5b* in FIG. 5, namely, from a mask shape *5a* at a low electron beam level to a mask shape *5b* at a high electron beam level.

This phenomenon in which the shadow mask is expanded toward the panel 2 as a result of the impingement of electron beams is called "doming" in the art. In this regard, FIG. 4 illustrates major portions of FIG. 3 on an enlarged scale. The positional relations between the fluorescent material 6 and an electron beam 7 before and after the doming are discussed below with reference to FIG. 5.

When the screen luminosity is low due to a low electron beam level, the shadow mask is in a state as shown at *5a* in FIG. 4. Accordingly, the center of the electron beam 7 correctly hits the center of the fluorescent material 6. This state is illustrated in FIG. 5(A). As seen in FIG. 2, the shadow mask 5 is initially set in a predetermined position *5a* which is determined such that the center of the electron beam 7 from a beam outlet for red color of the electron gun 4 hits the center of the red fluorescent material 6.

As the screen luminosity becomes higher with an increasing electron beam level, the doming phenomenon occurs to the shadow mask as a result of its temperature elevation, shifting the shadow mask 5 to the position indicated at *5b* in FIG. 5. Consequently, the center of the electron beam 7 is deviated from the center of the fluorescent material 6. This state is illustrated in FIG. 5(B). As seen in FIG. 5, as a result of the positional deviation of the shadow mask 5 from *5a* to *5b*, the tracks of the electron beam 7 are shifted parallelly inward, making it difficult for the electron beam 7 to hit the fluorescent material correctly and exciting the fluorescent material in inwardly waned condition in microscopic observation.

FIG. 5 illustrates microscopically observed positional relations (deviations), showing that the actual position of the electron beam 7 is shifted inward relative to the fluorescent material 6 as a result of the doming phenomenon.

In this way, the doming drops the luminosity in peripheral areas to impair the uniformity across the whole screen area. Therefore, attempts have been made to suppress the temperature elevation of the shadow mask by putting a carbon graphite film on the inner surface of the panel 2 or by putting a bismuth oxide film on the inner surface of the shadow mask, or to suppress the thermal deformation of the shadow mask 5 by employing as its material an Invar material (a nickel-iron alloy) of low thermal expansion (with a thermal expansion coefficient of about $1.2\times10^{-6}$/° C.) in place of iron (with a thermal expansion coefficient of about $12\times10^{-6}$/° C.) which has thus far been generally adopted.

On the other hand, there have been strong demands in the market for suppression of leakage of magnetic fields from CRT displays, particularly, magnetic fields of 1 kHz to 400 kHz. To comply with these demands, it has become a usual practice to mount compensation coils 9 over and under the deflection yoke 8 as shown in FIG. 6.

The horizontal deflection current or part of the horizontal deflection current is passed through these paired compensation coils 9 thereby to produce magnetic fields (compensation magnetic fields), which act to bend the tracks of the electron beam 7, impinging the electron beam 7 in outwardly shifted positions relative to the fluorescent material 6 in microscopic observation as shown in FIG. 7(A). This is because the tracks of the electron beam 7 are deviated only in the horizontal direction by the magnetic fields produced by the horizontal deflection current flowing through the compensation coils 9.

Generally, the mount position of the deflection yoke 8 in the axial direction of CRT is set at a reference position 10 as shown in FIG. 8(B). In this state, satisfactory color purity is obtained as long as the center of the electron beam 7 is in alignment with the center of the fluorescent material 6 as shown in FIG. 9(B). However, if the mount position of the deflection yoke 8 is shifted toward the panel 2 from the reference position 10 as shown in FIG. 8(A), the electron beam 7 is shifted inward relative to the fluorescent material 6 as shown in FIG. 9(A), putting the fluorescent material 6 in outwardly waned condition in microscopic observation.

Conversely, if the deflection yoke 8 is shifted toward the electron gun 4 as shown in FIG. 8(C), the fluorescent material is put in inwardly waned condition as shown in FIG. 9(C). This adjustment of the yoke position is generally called "YPB adjustment".

Therefore, a countermeasure against doming, it has been the general practice to shift the mount position of the deflection yoke 8 slightly toward the panel 2 as shown in FIG. 8(A) to cure the symptom shown in FIG. 5(B).

In this connection, in a case where the paired compensation coils 9 are mounted over and under the deflection yoke 8 for the purpose of suppressing the leakage of magnetic fields from a CRT display, the landing condition in the horizontal direction is varied, making it difficult to attain the state of just landing as shown in FIGS. 8(B) and 9(B). Namely, in case the deflection yoke 8 is set in the position of FIG. 8(B), regardless of the compensation coils 9, the provision of the compensation coils 9 will invite the condition of FIG. 7(A).

If the deflection yoke 8 is shifted toward the panel 2 as shown in FIG. 8(A) for the purpose of overcoming the defective purity (inward waning) at the ends of X-axis, outward waning takes place at the ends of Y-axis as shown in FIG. 7(B) despite the improved purity at the ends of X-axis. Therefore, as a matter of fact, due to the difficulty of setting the position of the deflection yoke 8, there has been no choice but to take a compromising measure of setting the deflection yoke in an intermediate position between the yoke positions shown in FIGS. 7(A) and 7(B).

This difference in purity between the X-axis ends, where the beam is in the just landing condition, and the Y-axis ends, where the beam is out of the just landing condition, is generally referred to as H/V differential.

In this connection, a number of publications have been brought to our attention, including an article "Technical Movements In Mitsubishi's Large-Screen High-Quality Brown Tubes" in "TV TECHNOLOGY", pp. 17--29, June 1990, dealing with a technology for preventing deformations of the shadow mask of CRT display, and Japanese Laid-Open Patent Application H2-46085 concerning reductions of magnetic field leakage from display devices.

With a conventional CRT display of the above construction, an increase in production cost of the CRT display is inevitable in case a film of carbon graphite or bismuth oxide is coated on the inner surface of the panel 2 or shadow mask 5 or in case an Invar material of low thermal expansion is employed for the shadow mask 5 for the purpose of suppressing the doming phenomenon. Besides, there is another problem that extremely complicate meticulous skills are required to eliminate the mislanding, caused by doming or H/V differential, through adjustments of the mount position of the deflection yoke 8 in a compromising way as mentioned above.

SUMMARY OF THE INVENTION

The present invention contemplates to eliminate the problems as discussed above.

It is an object of the present invention to provide a CRT display which can correct the mislanding of the electron beam in a simplified manner without complicate adjustments of the mount position of the deflection yoke.

It is another object of the present invention to provide a CRT display which can correct the mislanding without entailing increases in cost, namely, by suppressing doming without use of a costly device.

In accordance with the present invention, there is provided, for achieving the above-stated objectives, a CRT display, comprising: a bipolar electromagnet located at a neck portion of a cathode ray tube and having field coils to produce a bipolar magnetic field for imparting a corrective horizontal or vertical deflection to an electron beam being deflected by the deflection yoke, upon receiving, from a current supply circuit, a sawtooth current with positive and negative alternations in synchronism with the deflection current of the cathode ray tube.

In the present invention, the bipolar electromagnet is adopted to produce a bipolar magnetic field on the basis of an alternating sawtooth current which is supplied to its field coils in synchronism with the deflection current, varying the landing condition by the bipolar magnetic field, which has the same effect on the respective electron beams for the blue, green and red colors in straightening out the mislanding conditions as caused by doming and H/V differential.

The above and other objects, features and advantages of the invention will become apparent from the following description of preferred embodiments, taken in conjunction with the accompanying drawings which are given only for illustrative purposes and therefore should not be construed as being limitative of the invention in any way whatsoever.

DESCRIPTION OF PREFERRED EMBODIMENTS

Hereafter, the invention is described in greater detail by way of its preferred embodiments with reference to the accompanying drawings.

EMBODIMENT 1

Figure 10:
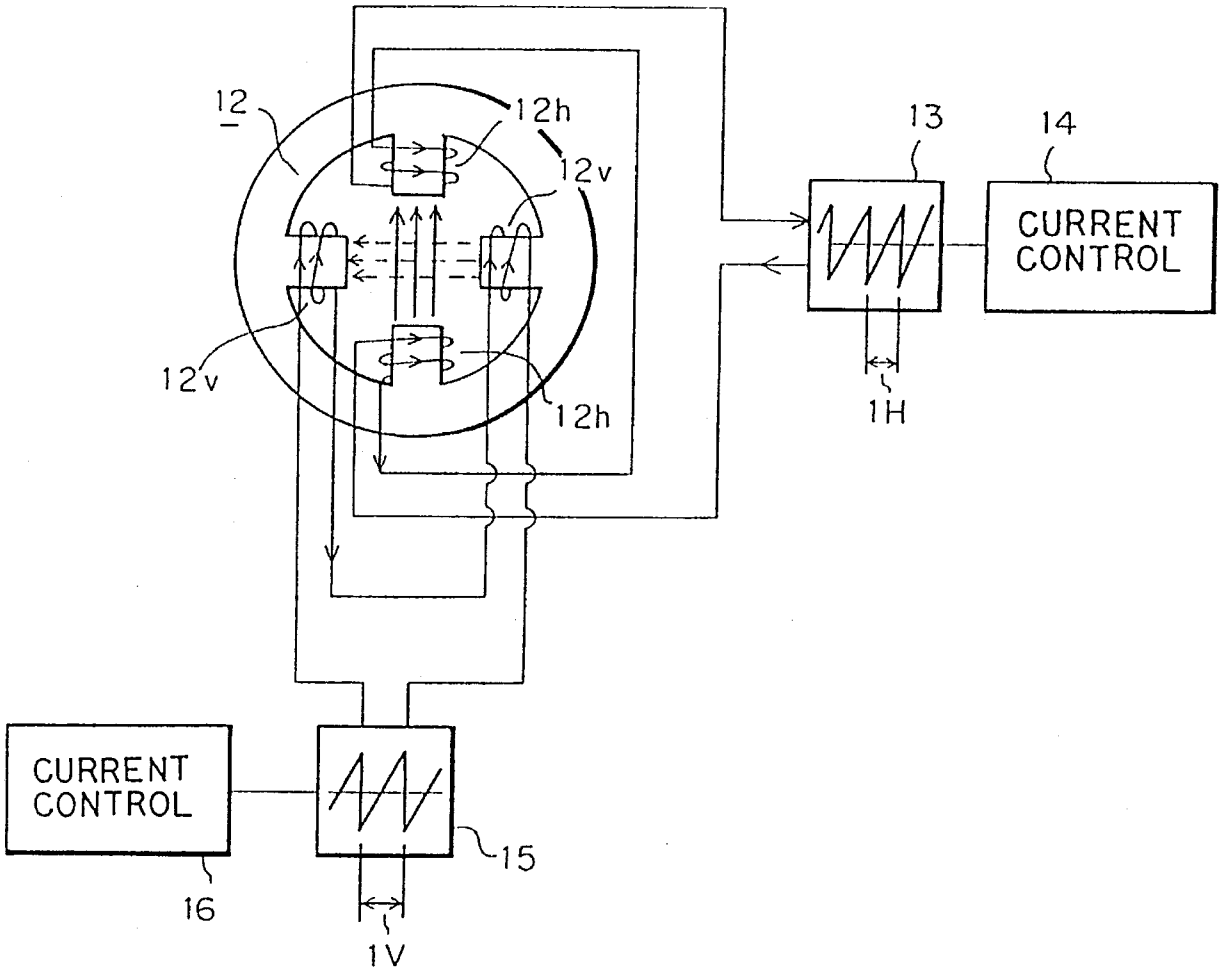
FIG. 10 is a diagrammatic view of a major portion of a CRT display in a first embodiment of the invention.
Figure 11:
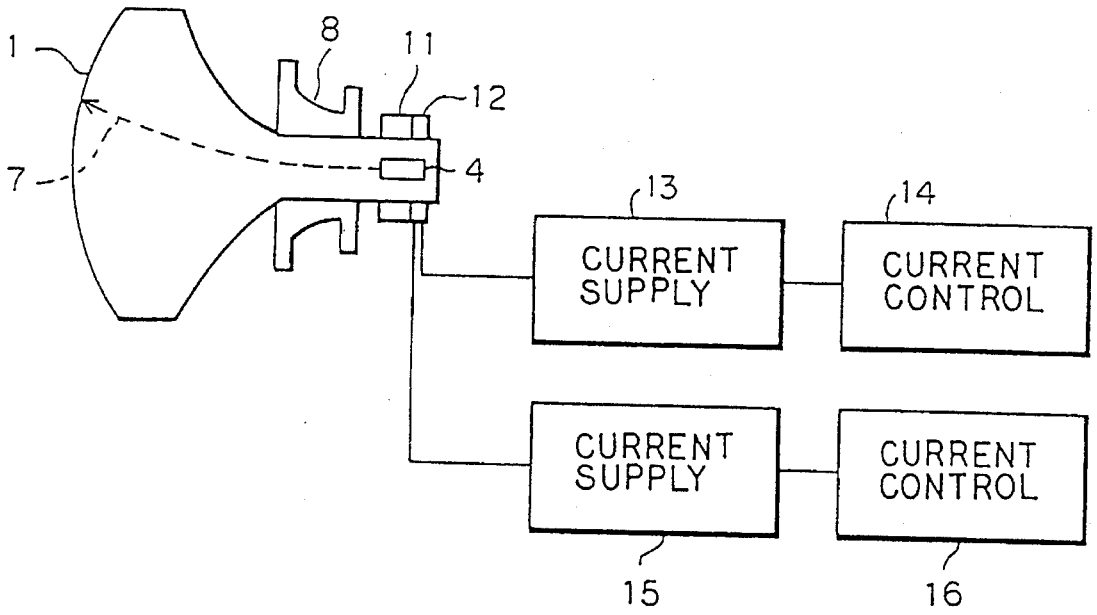
FIG. 11 is a diagrammatic illustration explanatory of the mount position of a bipolar electromagnet on the CRT display in the first embodiment of the invention.

FIG. 10 shows the arrangement of essential parts in a first embodiment of the invention, and FIG. 11 is a diagrammatic illustration showing a bipolar electromagnet which is mounted in position. In these figures, indicated at 1 is a CRT, at 4 is an electron gun, at 7 is an electron beam, at 8 is a deflection yoke, at 11 is a convergence purity magnet assembly (hereafter referred to as "CP-ASSY") which is located on the side of the electron gun 4 rearward of the deflection yoke 8.

Designated at 12 is a bipolar electromagnet which is located behind the CP-ASSY 11, at $\mathbf{12}_v$ is a field coil which generates a bipolar magnetic field to impart a deflection in the vertical direction to the electron beam 7 being deflected by the deflection yoke 8, and at $\mathbf{12}_h$ is a field coil which similarly generates a bipolar magnetic field to impart a deflection to the electron beam 7 in the horizontal direction.

The reference 13 denotes a current supply circuit which supplies the field coil $\mathbf{12}_h$ with sawtooth current with positive and negative alternations in synchronism with the horizontal deflection current, and the reference 14 denotes a current control circuit which controls the amplitude of the sawtooth current to be produced by the current supply circuit 13. Similarly, the reference 15 denotes a current supply circuit which supplies the field coil $\mathbf{12}_v$ with sawtooth current with positive and negative alternations in synchronism with the vertical deflection current, and the reference 16 denotes a current control circuit which controls the amplitude of the sawtooth current to be produced by the current supply circuit 15.

Figure 12:
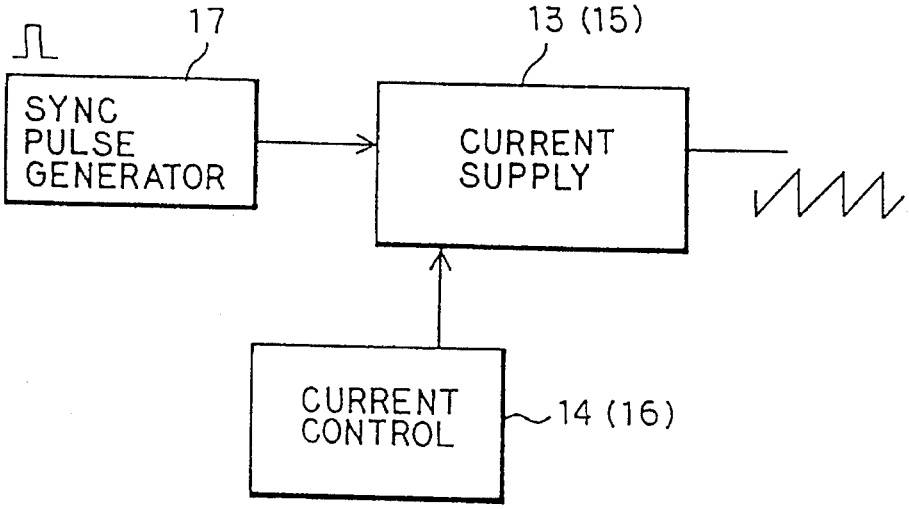
FIG. 12 is a block diagram showing an example of sawtooth current supply employed in the CRT display of the first embodiment.
Figure 13:
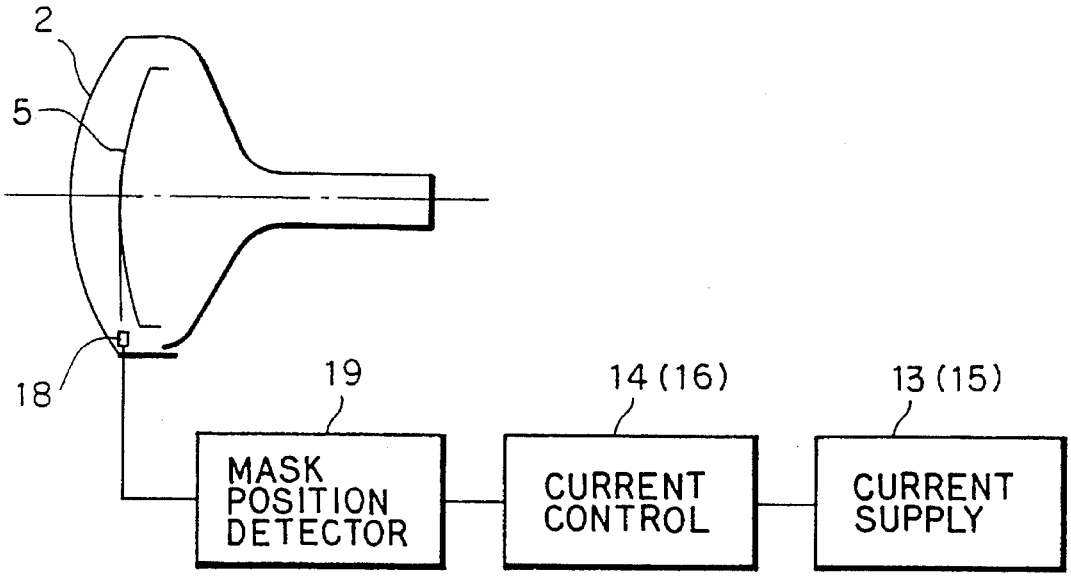
FIG. 13 is a block diagram showing an example of sawtooth current amplitude control employed in the CRT display of the first embodiment.

The current supply circuits 13 and 15 are arranged to generate sawtooth current in synchronism with horizontal or vertical deflection current, for example, on the basis of pulse signals produced by a sync pulse generator circuit 17 as shown in FIG. 12. The current control circuits 14 and 16 control the current supply circuits 13 (or 15) to vary the amplitude of the sawtooth current, for example, according to the information on doming positional deviations of the shadow mask 5, which is detected by a sensor 18 and supplied from a mask position detecting circuit 19.

In operation, the current supply circuit 13 supplies the field coil $\mathbf{12}_h$ of the bipolar electromagnet 12 with sawtooth current alternating in synchronism with the horizontal deflection current. The sawtooth current with positive and negative alternations undergoes changes in amplitude and polarity at the current supply circuit 13 under control of the current control circuit 14.

Figure 14A:
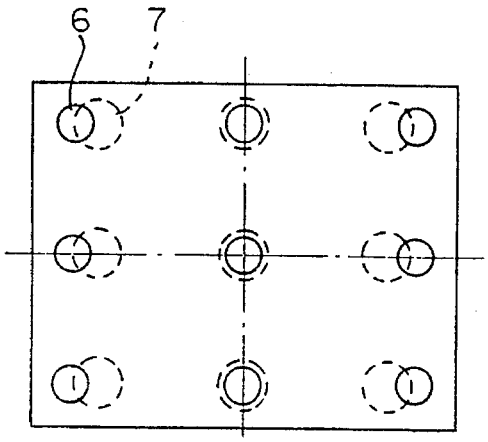
FIG. 14 is a diagrammatic illustration explanatory of changes in the landing condition on the CRT display of the first embodiment.

Upon supplying the field coil $\mathbf{12}_h$ with sawtooth current in synchronism with the horizontal deflection current, the landing condition at the ends of X-axis is varied as shown in FIG. 14(A). In case of FIG. 14(A), the landing position of the electron beam 7 is shifted inward relative to the fluorescent material 6 in the left half of the screen in microscopic observation.

Figure 15A:
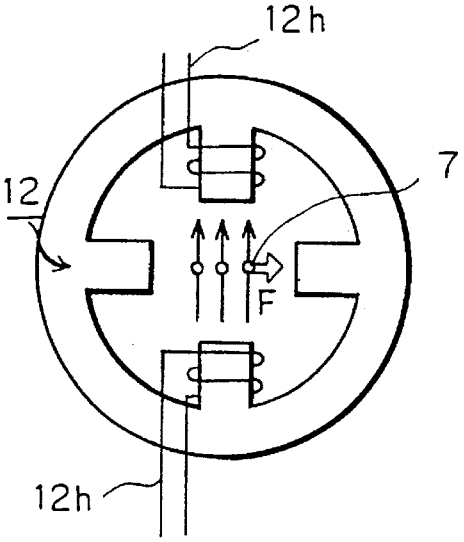
FIG. 15 is a diagrammatic illustration explanatory of shifts of the electron beam position by the field coils and their bipolar magnetic fields on the CRT display of the first embodiment.

In the right half of the screen where the polarity of the sawtooth current is reversed, the landing position of the electron beam 7 is shifted also in an inward direction relative to the fluorescent material 6 to make outwardly waned landings. FIG. 15(A) shows an electron beam 7 making inwardly shifted landings in the right half of the screen under the influence of force F which is exerted by the bipolar magnetic field of the field coil $\mathbf{12}_h$.

Figure 14B:
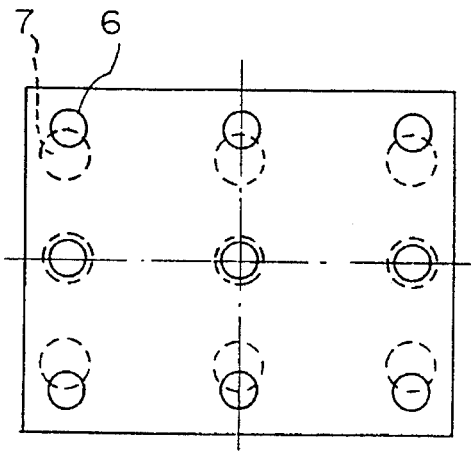
Figure 15B:
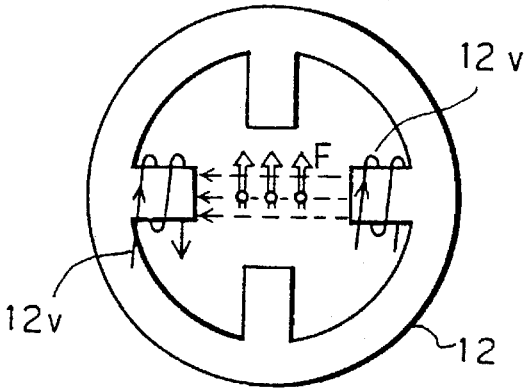

Similarly, as sawtooth current in synchronism with the vertical deflection current is supplied to the field coil $\mathbf{12}_v$ by the current supply circuit 15 under control of the current control circuit 14, the landing condition is varied by the sawtooth current as will be easily understood from FIGS. 14(B) and 15(B).

Figure 16:
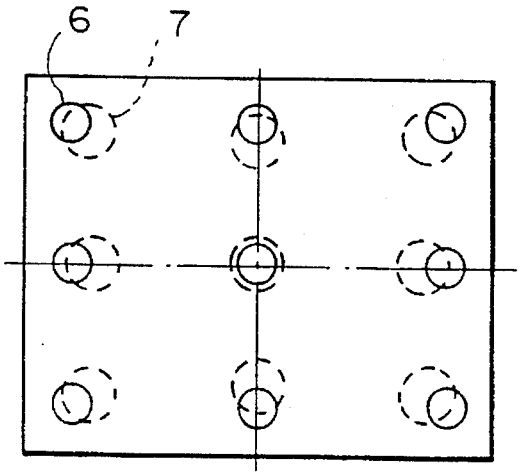
FIG. 16 is a diagrammatic illustration explanatory of changes in the landing condition on the CRT display in the first embodiment of the invention.

Upon supplying the field coils $\mathbf{12}_h$ and $\mathbf{12}_v$ with sawtooth current in synchronism with the horizontal deflection current and sawtooth current in synchronism with the vertical deflection current, respectively, the landing condition is varied in a composite way as shown in FIG. 16 as a result of combination of the landing conditions shown in FIGS. 14(A) and 14(B).

Figure 1:
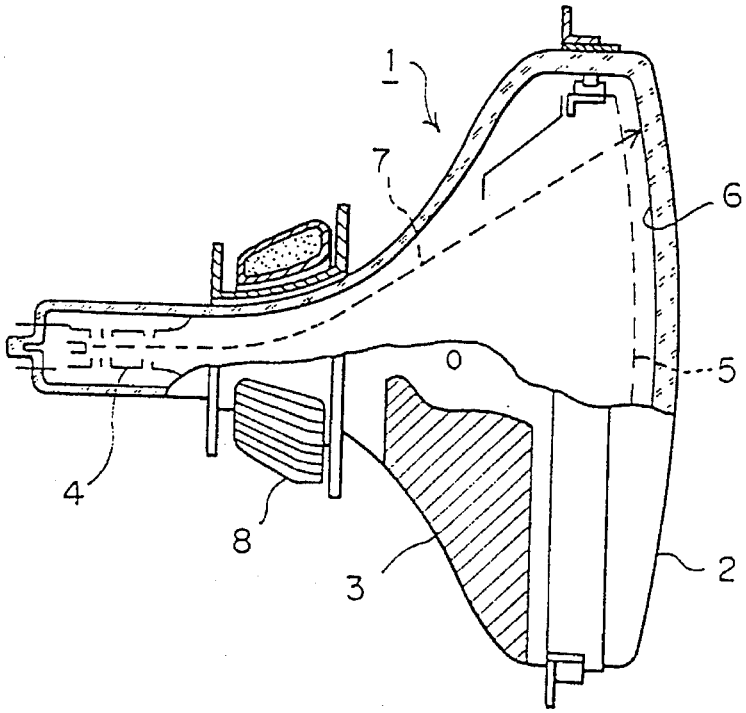
FIG. 1 (PRIOR ART)
FIG. 1 is a partly cutaway sectional view of a CRT, shown as an example of conventional CRT displays.
Figure 2:
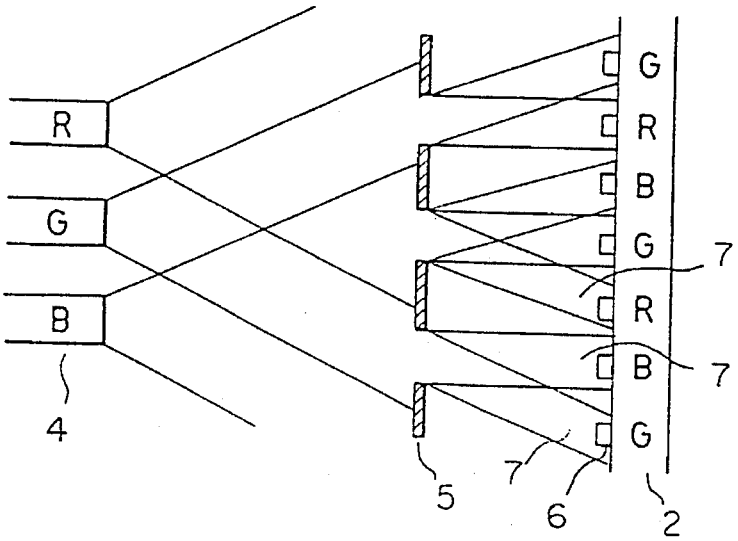
FIG. 2 (PRIOR ART)
FIG. 2 is a diagrammatic illustration explanatory of the principles of fluorescence of CRT.
Figure 3:
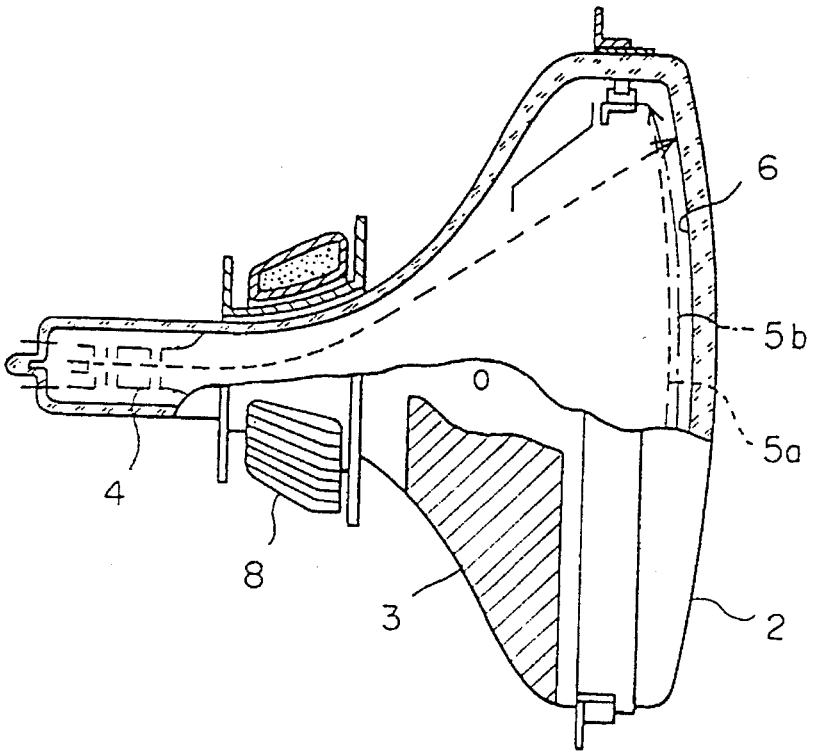
FIG. 3 (PRIOR ART)
FIG. 3 is a partly cutaway sectional view of a CRT, employed for explanation of the doming phenomenon of a shadow mask.
Figure 4:
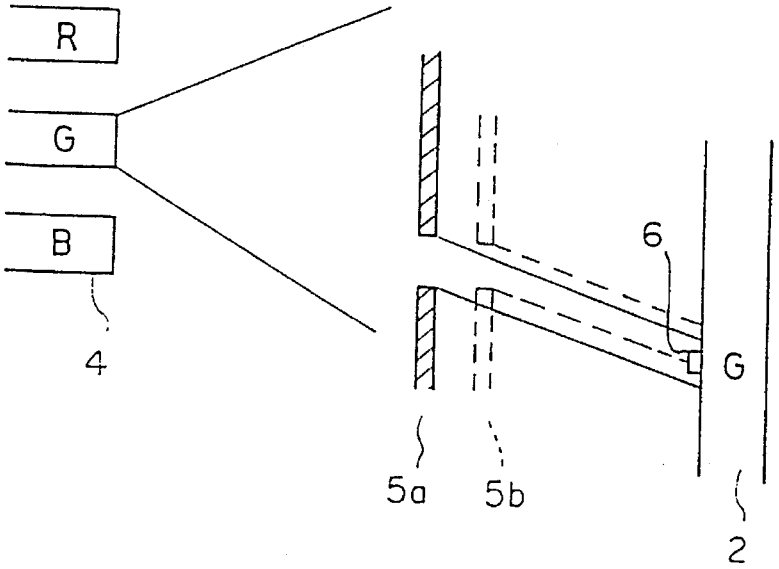
FIG. 4 (PRIOR ART)
FIG. 4 is an enlarged view of major portion of the CRT.
Figure 5A:
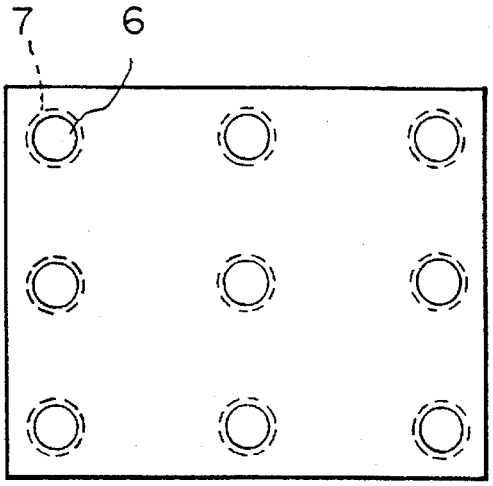
FIG. 5(A) (PRIOR ART)
FIG. 5 is a diagrammatic illustration explanatory of changed in landing condition.
Figure 5B:
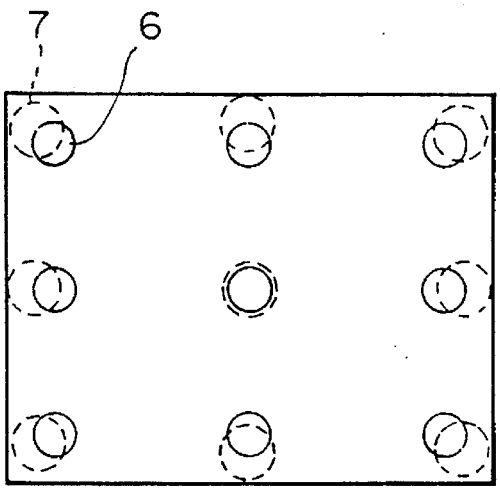
FIG. 5(B) (PRIOR ART)
Figure 6:
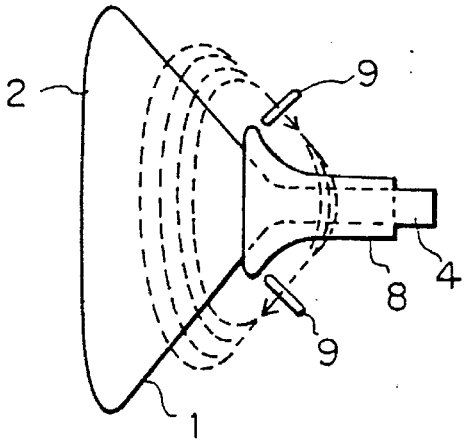
FIG. 6 ( PRIOR ART )
FIG. 6 is a diagrammatic illustration explanatory of the manner of suppressing magnetic field leakage by compensation coils on a conventional CRT display.

Namely, the doming phenomenon of FIG. 5(B) can be easily corrected in terms of color purity, by supplying the field coils $\mathbf{12}_h$ and $\mathbf{12}_v$ of the bipolar electromagnet 12 with sawtooth currents in synchronism with the horizontal and vertical deflection currents, respectively.

Figure 7A:
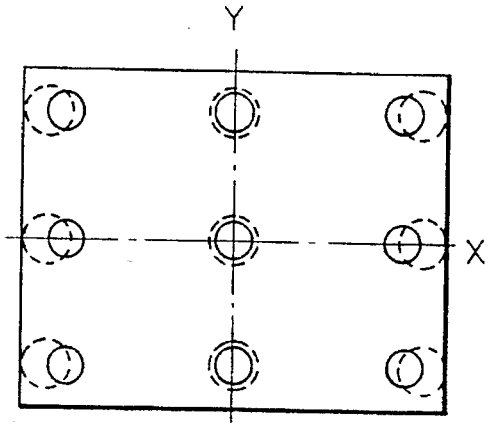
FIG. 7(A) (PRIOR ART)
FIG. 7 is a diagrammatic illustration explanatory of changes in landing condition caused by the compensatory magnetic fields produced by the compensation coils.
Figure 7B:
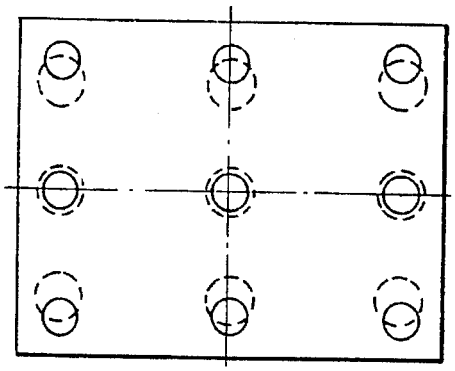
FIG. 7(B) (PRIOR ART)
Figure 8A:
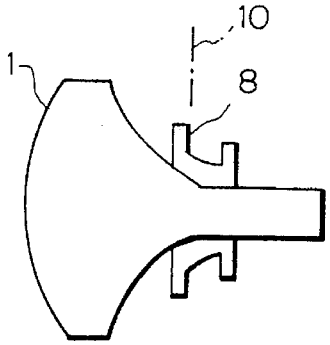
FIG. 8(A) (PRIOR ART)
FIG. 8 is a diagrammatic illustration explanatory of adjustments of the deflection yoke mount position adopted by the conventional CRT display for correction of mislanding.
Figure 8B:
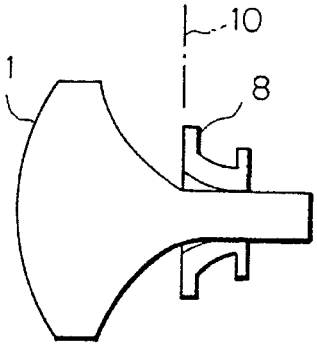
FIG. 8(B) (PRIOR ART)
Figure 8C:
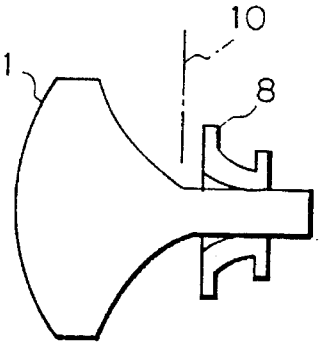
FIG. 8(C) (PRIOR ART)
Figure 9A:
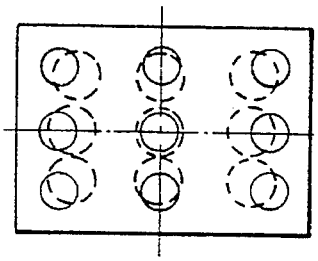
(PRIOR ART) FIG. 9(A)
FIG. 9 is a diagrammatic illustration explanatory of changes in landing condition resulting from the adjustment of the deflection yoke mount position on the conventional CRT display.
Figure 9B:
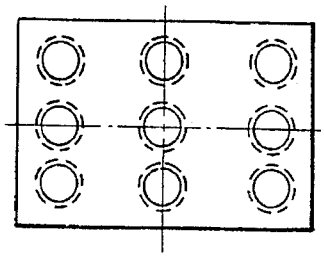
(PRIOR ART) FIG.9(B)
Figure 9C:
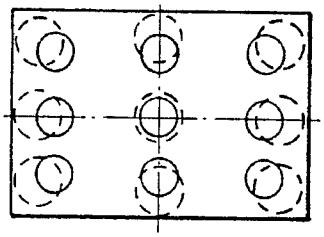
(PRIOR ART) FIG.9(C)

Further, in case the field coil $\mathbf{12}_h$ alone is supplied with the sawtooth current in synchronism with the horizontal deflection current, it is possible to impart the change of FIG. 14(A) in compensation for the mislanding caused by addition of the compensation coils 9 as shown in FIG. 7(A).

EMBODIMENT 2

Figure 17:
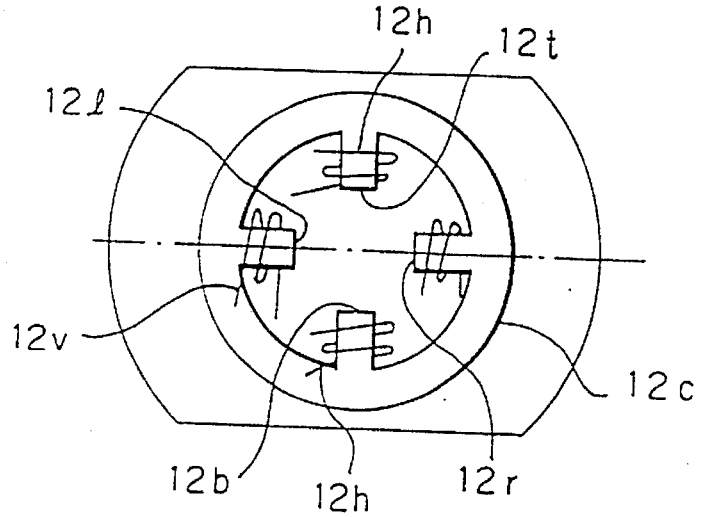
FIG. 17 is a diagrammatic illustration of a bipolar electromagnet on a CRT display in another embodiment of the invention.

The bipolar electromagnet 12 which is located in a rear portion of CP-ASSY 11 in the above-described Embodiment 1 may be provided in other positions. FIG. 17 shows a bipolar electromagnet 12 having four salient pole pieces $\mathbf{12}_t$, $\mathbf{12}_b$, $\mathbf{12}_1$ and $\mathbf{12}_r$ on a core back $\mathbf{12}_c$, which is located on a separator end face of the deflection yoke 8, and field coils $\mathbf{12}_h$ or $\mathbf{12}_v$ wound on the salient pole pieces $\mathbf{12}_t$, $\mathbf{12}_b$, $\mathbf{12}_1$ and $\mathbf{12}_r$.

More specifically, the field coils $\mathbf{12}_h$ which are wound on upper and lower salient pole pieces $\mathbf{12}_t$ and $\mathbf{12}_b$ are connected to the current supply circuit 13, while the field coils $\mathbf{12}_v$ which are wound on the left and right pole pieces $\mathbf{12}_1$ and $\mathbf{12}_r$ are connected to the current supply circuit 15, thereby to produce horizontal and vertical bipolar magnetic fields as shown in FIGS. 10 and 15.

EMBODIMENT 3

Figure 18:
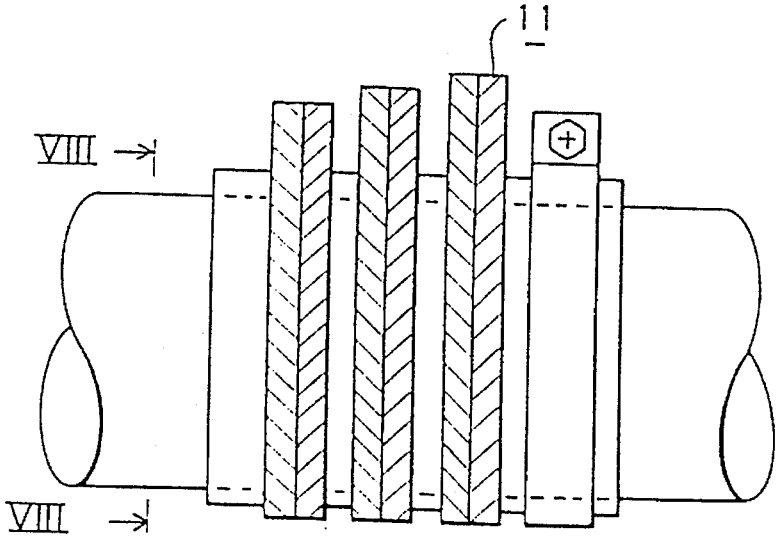
FIG. 18 is a diagrammatic side view of a CP-ASSY explanatory of the bipolar electromagnet on the CRT display in the second embodiment of the invention.
Figure 19:
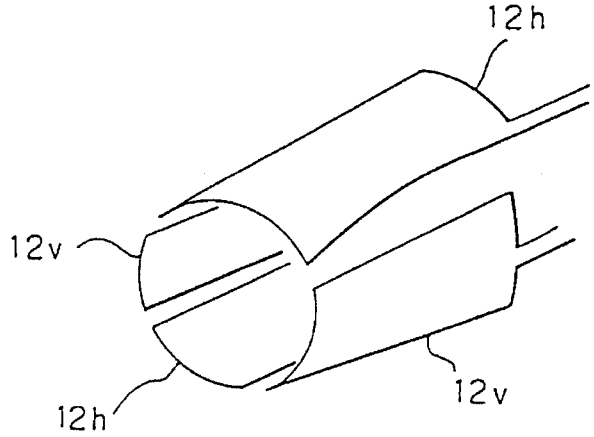
FIG. 19 is a perspective view of field coils in the embodiment of FIG. 18.
Figure 20:
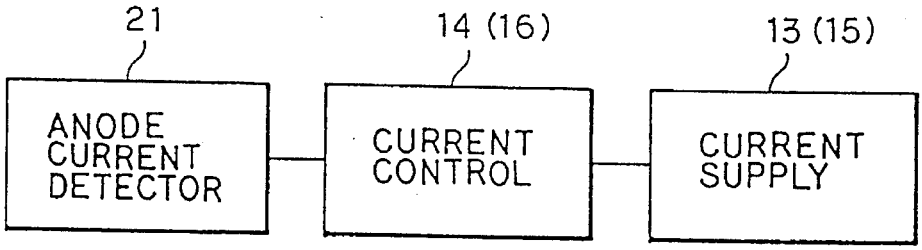
FIG. 20 is a block diagram showing an example of amplitude control for sawtooth current in still another embodiment of the invention.
Figure 21:
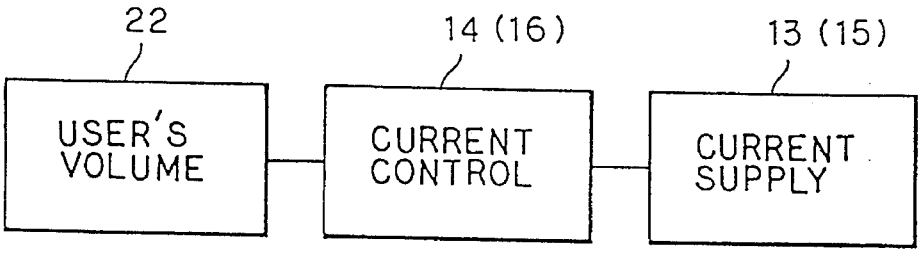
FIG. 21 is a block diagram showing an example of amplitude control for sawtooth current in still another embodiment of the invention.

FIGS. 18 and 19 show an alternative location of the bipolar electromagnet, of which FIG. 18 is an outer view of the CP-ASSY 11 and FIG. 19 is a perspective view of an electromagnet taken in the direction of arrow VIII in FIG. 18. In this embodiment, field coils $\mathbf{12}_h$ and $\mathbf{12}_v$ are incorporated into the CP-ASSY 11 to perform the above-described functions in the same manner as the coils shown in FIG. 17.

EMBODIMENT 4

Instead of directly detecting a deformation of the shadow mask as in the foregoing embodiments, this embodiment is arranged to detect a shadow mask deformation which is proportional to the anode current, by means of an anode current detection circuit 21 which is adapted to detect a voltage proportional to the anode current. The current control circuit 14 (16) controls the current supply circuit 13 (15) to vary amplitude of the sawtooth current according to the detected voltage.

EMBODIMENT 5

Alternatively, instead of automatically adjusting the amplitude of the sawtooth current after direct or indirect detection of a shadow mask deformation as in the foregoing embodiments, arrangements may be made to permit manual adjustment of the sawtooth current amplitude through manipulation of a central device such as a user's volume control which is provided on the front or side wall of the display casing for access by a user.

As explained in the foregoing description, the CRT display according to the present invention has a bipolar electromagnet mounted on a neck portion of the CRT display, supplying the field coils of the electromagnet with sawtooth current alternating between positive and negative in synchronism with the deflection current of the display to produce a bipolar magnetic field which has the same effects on electron beams for blue, green and red colors in changing their landing conditions for correction of mislandings as caused by doming of the shadow mask or by the H/V differential. Thus, the CRT display of the invention contributes to prevent degradations in color purity in an economical manner.

What is claimed is:

1. A CRT display of the type having an electromagnetic deflection yoke located externally in the vicinity of a neck portion of a cathode ray tube to deflect electron beams, from an electron gun located in said neck portion of the cathode ray tube, in a first direction, thereby irradiating a fluorescent surface on a panel portion of said tube to produce an image thereon, said CRT display comprising:

a bipolar electromagnet having field coils located at said neck portion of said cathode ray tube and having at least first field coils to produce a bipolar magnetic field for imparting a deflection in said first direction to an electron beam being deflected by said deflection yoke;

a current supply circuit for supplying said field coils with sawtooth current with positive and negative alternations in synchronism with the deflection current of said cathode ray tube;

a current control circuit for controlling the amplitude of said sawtooth current to be produced by said current supply circuit; and wherein said bipolar electromagnet is constituted by field coils wound on an even number of salient pole pieces located in the vicinity of said deflection yoke.

2. A CRT displays a defined in claim 1, wherein said bipolar electromagnet comprises field coils arranged to form at least part of a convergence purity magnet assembly.

3. A CRT display as defined in claim 1, wherein said first direction is vertical.

4. A CRT display having an electromagnetic deflection yoke located externally in the vicinity of a neck portion of a cathode ray tube to deflect electron beams, from an electron gun located in said neck portion of the cathode ray tube, in a first direction, thereby irradiating a fluorescent surface on a panel portion of said tube to produce an image thereon, said CRT display comprising:

a bipolar electromagnet having field coils located at said neck portion of said cathode ray tube and having at least first field coils to produce a bipolar magnetic field for imparting a deflection in said first direction to an electron beam being deflected by said deflection yoke;

a current supply circuit for supplying said field coils with sawtooth current with positive and negative alternations in synchronism with the deflection current of said cathode ray tube;

a current control circuit for controlling the amplitude of said sawtooth current to be produced by said current supply circuit; and wherein said first direction is horizontal.

5. A CRT display as defined in claim 4, wherein said deflection yoke is also located to deflect said electron beams in a vertical direction, and wherein said field coils also have second field coils to produce a bipolar magnetic field in the vertical direction.

6. A CRT display having an electromagnetic deflection yoke located externally in the vicinity of a neck portion of a cathode ray tube to deflect electron beams, from an electron gun located in said neck portion of the cathode ray tube, in a first direction, thereby irradiating a fluorescent surface on a panel portion of said tube to produce an image thereon, said CRT display comprising:

a bipolar electromagnet having field coils located at said neck portion of said cathode ray tube and having at least first field coils to produce a bipolar magnetic field for imparting a deflection in said first direction to an electron beam being deflected by said deflection yoke;

a current supply circuit for supplying said field coils with sawtooth current with positive and negative alternations in synchronism with the deflection current of said cathode ray tube;

a current control circuit for controlling the amplitude of said sawtooth current to be produced by said current supply circuit; and wherein said current control circuit includes a sensor for detecting a position of a shadow mask, and wherein said current control circuit controls said amplitude of said sawtooth current at least partially on the basis of the detected position of said shadow mask.

7. A CRT display having an electromagnetic deflection yoke located externally in the vicinity of a neck portion of a cathode ray tube to deflect electron beams, from an electron gun located in said neck portion of the cathode ray tube, in a first direction, thereby irradiating a fluorescent surface on a panel portion of said tube to produce an image thereon, said CRT display comprising:

a bipolar electromagnet having field coils located at said neck portion of said cathode ray tube and having at least first field coils to produce a bipolar magnetic field for imparting a deflection in said first direction to an electron beam being deflected by said deflection yoke;

a current supply circuit for supplying said field coils with sawtooth current with positive and negative alternations in synchronism with the deflection current of said cathode ray tube;

a current control circuit for controlling the amplitude of said sawtooth current to be produced by said current supply circuit; and wherein said current control circuit includes a control device to be set by a user, and wherein said current control circuit controls said amplitude of said sawtooth current at least partially on the basis of a setting of said control device by said user.

8. A CRT display as defined in claim 5, wherein said current control circuit includes a sensor for detecting a position of a shadow mask, and wherein said current control circuit controls said amplitude of said sawtooth current at least partially on the basis of the detected position of said shadow mask.

9. A CRT display as defined in claim 5, wherein said current control circuit includes a control device to be set by a user, and wherein said current control circuit controls said amplitude of said sawtooth current at least partially on the basis of a setting of said control device by said user.

* * * * *